United States Patent [19]

Yamada

[11] Patent Number: 4,561,514

[45] Date of Patent: Dec. 31, 1985

[54] AMUSEMENT VEHICLE

[75] Inventor: Kazuo Yamada, Tokyo, Japan

[73] Assignee: Togo Japan, Inc., Tokyo, Japan

[21] Appl. No.: 686,192

[22] Filed: Dec. 26, 1984

[30] Foreign Application Priority Data

Feb. 16, 1984 [JP] Japan ..... 59-27450

[51] Int. Cl.[4] ..... A63G 19/20

[52] U.S. Cl. ..... 180/8.6; 280/1.181; 280/1.204; 446/276

[58] Field of Search ..... 180/8.1, 8.6; 280/1.13, 280/1.181, 1.204, 1.201, 1.208; 446/276, 280, 285, 293, 294

[56] References Cited

U.S. PATENT DOCUMENTS

| | | | |
|---|---|---|---|
| 1,345,578 | 7/1920 | Burnett | 280/1.204 |
| 2,253,096 | 8/1941 | Sheldon | 280/1.13 X |
| 2,625,403 | 1/1953 | Alonzo | 280/1.204 |
| 2,627,419 | 2/1953 | Lindenbein | 280/1.204 X |

FOREIGN PATENT DOCUMENTS

| | | |
|---|---|---|
| 55-37698 | 3/1980 | Japan . |
| 55-51233 | 4/1980 | Japan . |
| 55-154083 | 11/1980 | Japan . |

*Primary Examiner*—John A. Pekar

*Attorney, Agent, or Firm*—Merchant, Gould, Smith, Edell, Welter & Schmidt

[57] ABSTRACT

An amusement vehicle has a hollow body shell which is shaped like, for example, a four-footed animal. Front and rear frames are provided inside the body shell, and are coupled to each other by a hollow shaft. The front and rear frames can correlatively rotate in the rolling direction around the hollow shaft. Front wheels are mounted on the front frame, and rear wheels on the rear frame. At least one of these wheels is rotated by a motor. Besides the front and rear wheels, front imitation legs and rear imitation legs are attached to the front and rear frames so as to be swingable in the longitudinal direction of the vehicle. The front and rear imitation legs are reciprocated back and forth by the motor through a power transmission shaft. The power transmission shaft is passed through the hollow shaft.

10 Claims, 10 Drawing Figures

AMUSEMENT VEHICLE

BACKGROUND OF THE INVENTION

The present invention relates to an amusement vehicle shaped like an animal or robot, and more specifically to an electric-powered amusement vehicle adapted to carry a child thereon so that the child can control the vehicle for amusement by himself.

Various amusement vehicles are conventionally used in recreation grounds or other amusement facilities. Typical amusement vehicles include baby cars carrying a storage battery. Some of these baby cars are shaped like animals, robots, etc. Although outwardly resembling animals or the like, however, the conventional baby cars of this type cannot operate in an animal-like manner, having only rotatable wheels attached to the bottom portion of the body as their means of movement. In other words, front and rear legs on either side of the body of baby cars are mere ornaments that never move. Despite the attractive appearance taking after animals or the like, therefore, these vehicles lack an interesting behavior.

Thereupon, amusement vehicles have recently been developed which outwardly can walk with their front and rear legs behaving like living animals. As an typical example of these vehicles, a walking/riding toy shaped like an animal is disclosed in Japanese Utility Model Publication No. 36232/82. In this walking/riding toy, when a motor is started by turning a switch on, cranks for front and rear legs are actuated. As these cranks are driven, the front and rear legs are swung back and forth. A wheel is attached to the lower end portion of each of the front and rear legs. The wheel can rotate only in the forward direction, that is, it is prevented from rotating reversely. Thus, the walking/riding toy can advance swinging its front and rear legs back and forth.

In the case of the prior art walking/riding toy constructed in this manner, however, one of the four wheels may sometimes be lifted off the running surface if the surface is bumpy or inclined. Further, this conventional amusement vehicle cannot advance without alternately swinging the front and rear legs which bear the weight of a rider. Accordingly, it is subject to a substantial driving energy loss, and is, therefore, low in running capability and in positional stability. Using the wheels which can rotate only in the forward direction, moreover, the walking/riding toy of this type can advance, but cannot back up. It is also subject to drawbacks such that it cannot smoothly change its course sideways, and that the turning radius for the change of course is long.

SUMMARY OF THE INVENTION

Accordingly, the object of the present invention is to provide an amusement vehicle capable of outwardly walking like an animal or the like, and of running smoothly with less driving energy loss and without a suspended wheel.

According to the present invention, there is provided an amusement vehicle which comprises a front frame including a front leg frame and front wheels attached to the lower portion of the front leg frame, the front wheels being adapted to change their course from side to side, a rear frame including a rear leg frame and rear wheels attached to the lower portion of the rear leg frame, a hollow shaft coupling the front and rear frames so as to be rockable in the rolling direction, thereby holding the front and rear wheels in contact with the ground, drive means for driving the amusement vehicle, the drive means including a motor for rotating at least one of the front and rear wheels, a pair of front imitation legs arranged in association with the front leg frame and swingable in the longitudinal direction of the vehicle, a pair of rear imitation legs arranged in association with the rear leg frame and swingable in the longitudinal direction of the vehicle, swinging means including a power transmission shaft movably passed through the hollow shaft and adapted to drive the front and rear imitation legs in association with one another through the medium of the power transmission shaft, steering means for changing the course of the front wheels as required, and a body shell covering the front and rear frames.

According to the above construction, the front and rear frames can correlatively rock in the rolling direction around the hollow shaft. Therefore, even if the running surface is bumpy or inclined, none of the wheels mounted on the front and rear frames will be lifted off the surface, that is, all the wheels will be able to be securely in contact with the surface. Thus, the driving wheel is prevented from racing, and the front and rear frames are free from an excessive load.

In the amusement vehicle according to the present invention, the power transmission shaft is passed through the hollow shaft, and the front and rear imitation legs are interlocked with one another in regular relation by means of the power transmission shaft. Outwardly, therefore, the imitation legs can move like those of a four-footed animal.

Besides the imitation legs, in the amusement vehicle of the present invention, the front and rear wheels are attached to the front and rear frames, respectively. The vehicle can run when at least one of these wheels is driven. Accordingly, the vehicle of the present invention is subject to less driving energy loss than that of the prior art walking toy which advances by alternately swinging its front and rear legs. Moreover, the vehicle of the invention can change its course more smoothly sideways, and can enjoy a shorter turning radius for the change of course. Furthermore, it can be backed up by reversing the driving wheel.

BRIEF DESCRIPTION OF THE DRAWINGS

FIG. 7(*b*) is a sectional view taken along line B-B of FIG. 7(*a*);

DETAILED DESCRIPTION OF THE PREFERRED EMBODIMENTS

Figure 1:
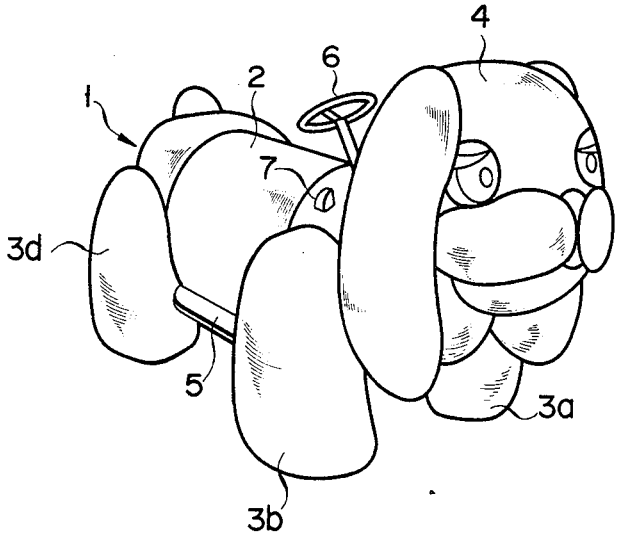
FIG. 1 is a general perspective view of a vehicle according to one embodiment of the present invention.

FIG. 1 shows an outline of an amusement vehicle according to one embodiment of the present invention. A hollow body shell 1 is shaped like a four-footed animal. The body shell 1 comprises a hollow trunk section 2 and a hollow head section 4 attached to the front end portion of the trunk section 2. The trunk section 2 and head section 4 are formed of a suitable molding material, such as FRP (fiber-reinforced plastics) or other plastic material.

The trunk section 2 is fitted with front imitation legs 3*a* and 3*b* and rear imitation legs 3*c* and 3*d* on either side thereof. These imitation legs 3*a* to 3*d*, which are also made of FRP, are formed of the trunk section 2. The manner of mounting the imitation legs 3*a* to 3*d* will be described in detail later.

A step 5 is attached to each side of the lower portion of the trunk section 2. Thus, a user can get astride the trunk section 2, using the step 5 as a foothold.

A steering wheel 6 is mounted on the top of the trunk section 2. The steering wheel 6 constitutes a part of steering means 59 which will be described in detail later. A changeover switch 7 for changing the moving direction (forward or backward) of the vehicle is disposed beside the steering wheel 6. Further, a coin slot (not shown) serving also as a start switch is provided in the vicinity of the changeover switch 7.

Referring now to FIGS. 2 to 7, various mechanisms inside the body shell 1 will be described.

Figure 2:
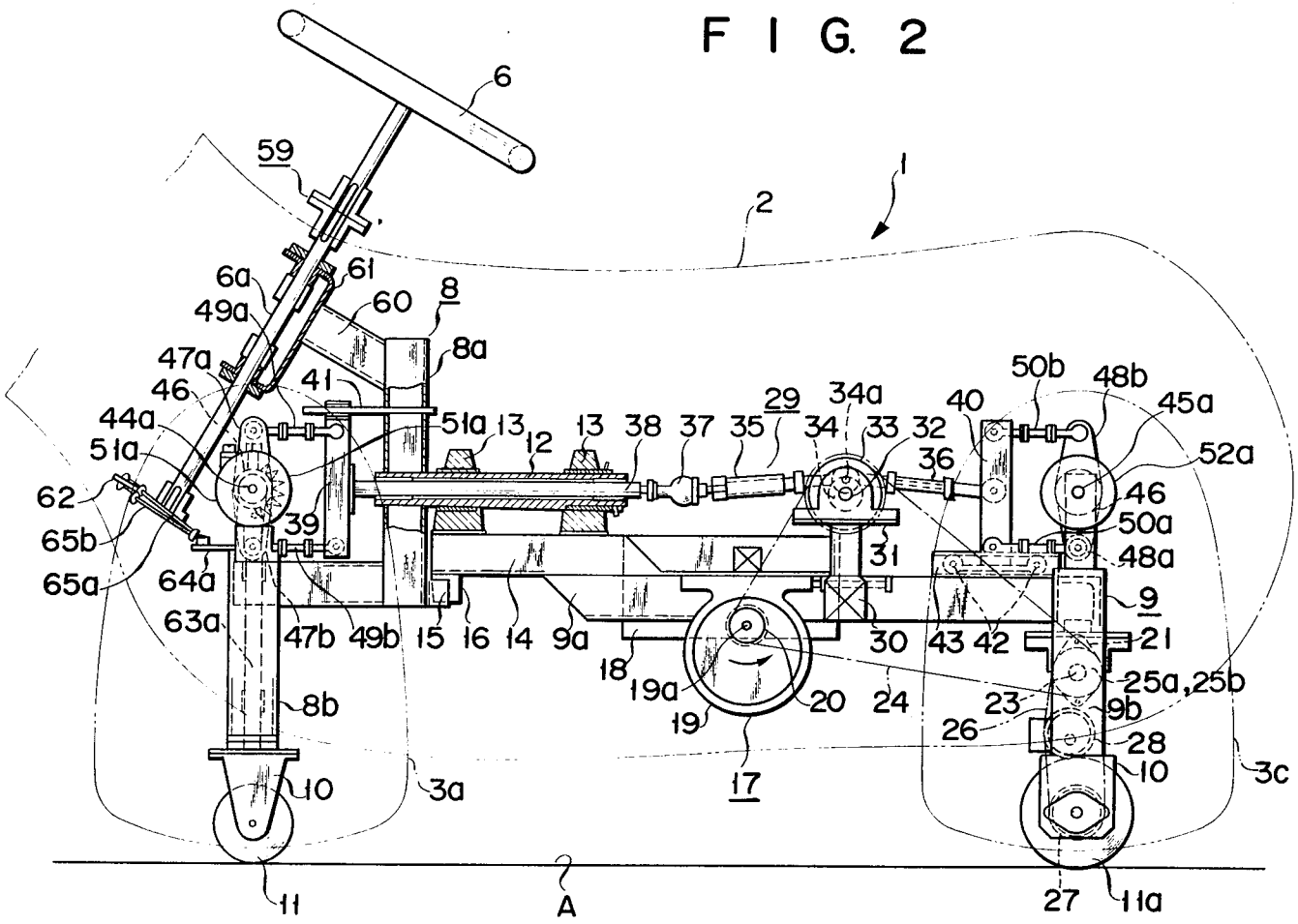
FIG. 2 is a side view partially in section illustrating the internal structure of the vehicle shown in FIG. 1.

A front frame 8 and a rear frame 9 shown in FIG. 2 are formed from steel or other material. The front frame 8 includes an L-shaped frame 8*a* and a front leg frame 8*b* fixed to the front portion of the L-shaped frame 8*a*. The L-shaped frame 8*a* has a substantially L-shaped profile. The front leg frame 8*b* is inverted-U-shaped as viewed frontways. Left and right vertical portions of the front leg frame 8*b* are covered with the front imitation legs 3*a* and 3*b*, respectively. Axle bearings 10, 10 are attached to the respective lower ends of the left and right vertical portions of the front leg frame 8*b*. A pair of front wheels 11, 11 are mounted on the axle bearings 10, 10, individually.

On the other hand, the rear frame 9 includes a center frame 9*a* and a rear leg frame 9*b* fixed to the rear end of the center frame 9*a*. The center frame 9*a* is elongated along the longitudinal direction of the vehicle. The rear leg frame 9*b* is inverted-U-shaped as viewed frontways. Left and right vertical portions of the rear leg frame 9*b* are covered with the rear imitation legs 3*c* and 3*d*, respectively. Another pair of axle bearings 10, 10 are attached to the respective lower ends of the left and right vertical portions of the rear leg frame 9*b*. Rear wheels 11 and 11*a* are mounted on these axle bearings 10, 10, individually.

Among these four wheels, only the wheel 11*a* is used as a driving wheel, and the remaining three as driven wheels.

A hollow shaft 12 is welded to the vertical portion of the L-shaped frame 8*a*. The hollow shaft 12 projects substantially horizontally (in the longitudinal direction of the vehicle) on the rear side of the L-shaped frame 8*a*.

The hollow shaft 12 is rotatably supported by a pair of bearings 13, 13 arranged in the longitudinal direction of the vehicle. The bearings 13, 13 are fixed on the upper surface of a front portion 14 of the center frame 9*a*. Thus, the front and rear frames 8 and 9 can rock in the rolling direction around the hollow shaft 12. The angle of relative rotation of the front and rear frames 8 and 9 is limited within a proper range by means of stoppers 15 and 16.

Drive means 17 for running the vehicle will now be described in detail. A storage battery 18 and a motor 19 are mounted on the rear frame 9. The motor 19 is provided with a speed reducer. A driving sprocket 20 is mounted on an output shaft 19*a* of the motor 19. A pair of bearings 21 and 22 (see FIG. 6) are provided on the left and right sides of the vehicle at the inside portion of the rear leg frame 9*b*. An intermediate shaft 23 is rotatably supported by the bearings 21 and 22. The intermediate shaft 23 is fitted with a first intermediate sprocket 25*a*. A first chain 24 is passed around the intermediate sprocket 25*a* and the driving sprocket 20. When the driving sprocket 20 rotates, therefore, the first intermediate sprocket 25*a* rotates correspondingly.

A second intermediate sprocket 25*b* is also mounted on the intermediate shaft 23. A driven sprocket 27 is mounted on the shaft of the wheel 11*a* which is located under the intermediate sprocket 25*b*. A second chain 26 is passed around the driven sprocket 27 and the second intermediate sprocket 25*b*. When the second intermediate sprocket 25*b* rotates, therefore, the driven sprocket 27 rotates correspondingly, so that the driving wheel 11*a* rotates. A tension sprocket 28 for adjusting the tension of the chain 26 is interposed between the intermediate sprocket 25*b* and the driven sprocket 27.

The drive means 17 with the aforementioned construction is fitted with swinging means 29 for swinging the imitation legs 3*a* to 3*d*. The swinging means 29 will now be described in detail.

A bearing supporting frame 30 is mounted on the center frame 9*a* halfway between the front and rear ends thereof. The bearing supporting frame 30 is fitted with left and right bearings 31. 31. An interlocking shaft 32 is rotatably supported by the bearings 31, 31. An interlocking sprocket 33 is mounted on the interlocking shaft 32. The chain 24 is passed around the interlocking sprocket 33. When the motor 19 rotates, therefore, the interlocking sprocket 33 also rotates.

The interlocking shaft 32 is also mounted with a crank 34 which has an eccentric pin 34*a*. The eccentric pin 34*a* is coupled with front and rear rods 35 and 36. A power transmission shaft 38 is coupled to the front end of the front rod 35 by means of a ball joint 37. The ball joint 37 allows the front rod 35 and the power transmission shaft 38 to rotate relatively, but restrains them from moving axially. The power transmission shaft 38 is passed through the hollow shaft 12 for forward and backward sliding motion.

A reciprocating plate 39 is fixed to the front end of the power transmission shaft 38. The reciprocating plate 39 is guided in its longitudinal movement by a guide member 41. The guide member 41 is attached to the L-shaped frame 8*a*, and extends horizontally.

A reciprocating plate 40 is coupled to the rear end of the rear rod 36. Rollers 42, 42 are rotatably arranged on each side of the lower portion of the reciprocating plate 40. The rollers 42, 42 are in rolling contact with a pair of guide members 43, 43 which are arranged on either side of the upper surface of the center frame 9*a*. The guide members 43, 43 are each channel-shaped and extend in the longitudinal direction of the vehicle. Thus, the reciprocating plate 40 is guided in its longitudinal movement by the guide members 43, 43.

Figure 3:
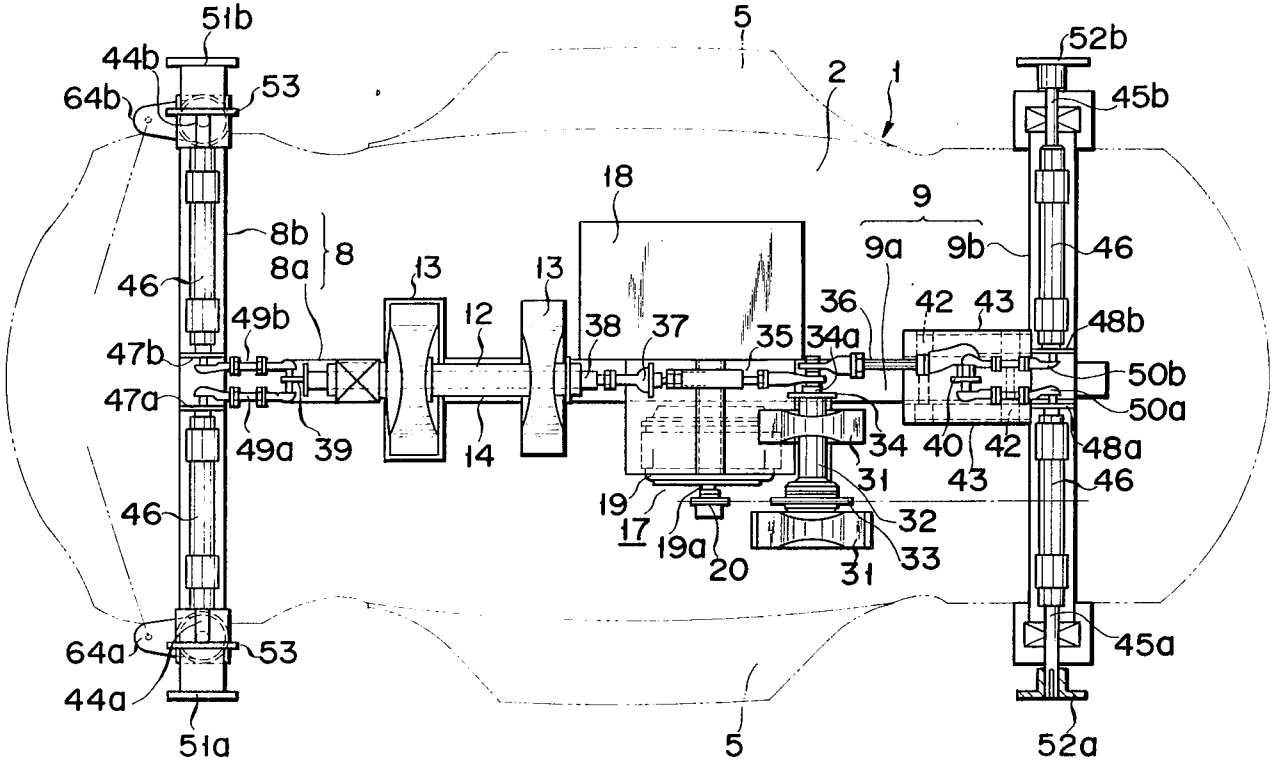
FIG. 3 is a plan view showing part of the internal structure of the vehicle of FIG. 1.
Figure 4:
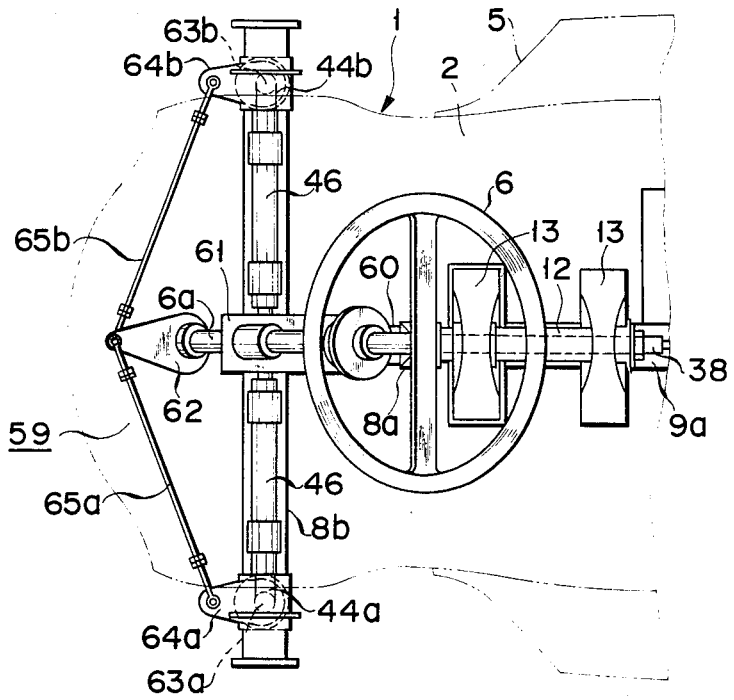
FIG. 4 is a plan view showing steering means of the vehicle of FIG. 1.

A pair of bearing cases 46, 46 are arranged across the vehicle in the front leg frame 8*b* (see FIG. 3). Rocking shafts 44*a* and 44*b* are rotatably passed through the bearing cases 46, 46, individually, to be supported thereby.

Figure 5:
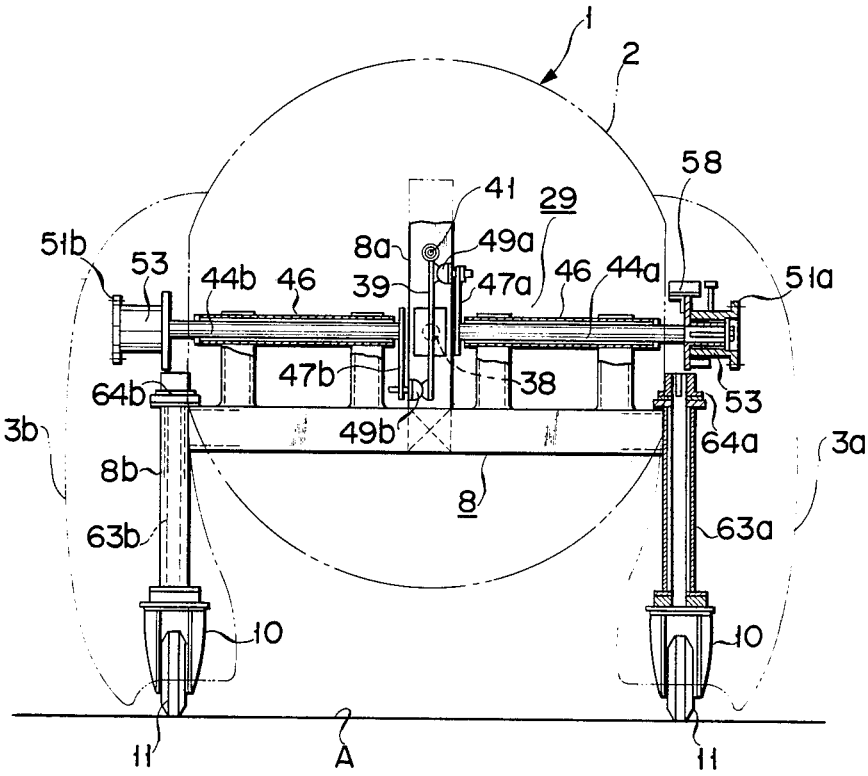
FIG. 5 is a front view partially in section illustrating a front frame of the vehicle of FIG. 1 and its surroundings.
Figure 6:
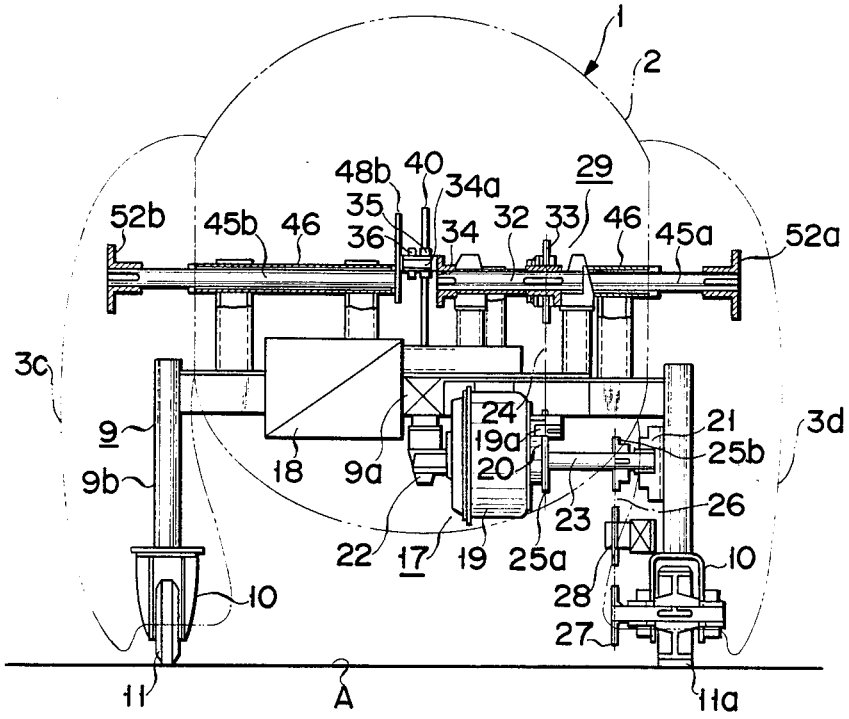
FIG. 6 is a front view partially in section illustrating a rear frame of the vehicle of FIG. 1 and its surroundings.

As shown in FIG. 5, levers 47*a* and 47*b* are attached to the inner end portions of the rocking shafts 44*a* and 44*b*, respectively. The levers 47*a* and 47*b* are coupled to the reciprocating plate 39 by means of a pair of front links 49*a* and 49*b*, respectively. The one link 49*a* is connected to the upper portion of the reciprocating plate 39, and the other link 49*b* to the lower portion of the reciprocating plate 39.

Another pair of bearing cases 46, 46 are arranged in the rear leg frame 9*b*. Rocking shafts 45*a* and 45*b* are rotatably passed through the bearing cases 46, 46, individually, to be supported thereby.

Levers 48*a* and 48*b* are attached to the inner end portions of the rocking shafts 45*a* and 45*b*, respectively. The levers 48*a* and 48*b* are coupled to the reciprocating plate 40 by means of a pair of rear links 50*a* and 50*b*, respectively. The one link 50*a* is connected to the lower portion of the reciprocating plate 40, and the other link 50*b* to the upper portion of the reciprocating plate 40.

In the swinging means 29 constructed in this manner, flanges 51*a* and 51*b* are attached to the outer end portions of the front rocking shafts 44*a* and 44*b*, respectively. The upper portions of the front imitation legs 3*a* and 3*b* are fixed to the flanges 51*a* and 51*b*, respectively. Thus, the front imitation legs 3*a* and 3*b* can swing back and forth as the rocking shafts 44*a* and 44*b* rotate.

Flanges 52*a* and 52*b* are attached to the other end portions of the rear rocking shafts 45*a* and 45*b*, respectively. The upper portions of the rear imitation legs 3*c* and 3*d* are fixed to the flanges 52*a* and 52*b*, respectively. Thus, the rear imitation legs 3*c* and 3*d* can swing back and forth as the rear rocking shafts 45*a* and 45*b* rotate.

Figure 7A:
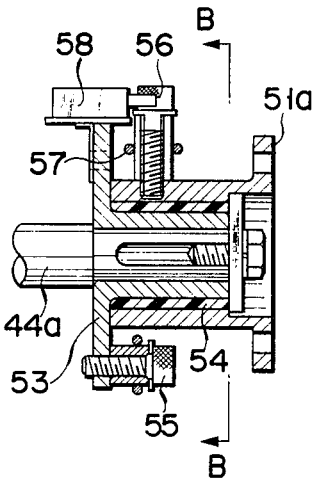
FIG. 7(*a*) is a sectional view showing a detector of the vehicle of FIG. 1 and its surroundings.
Figure 7B:
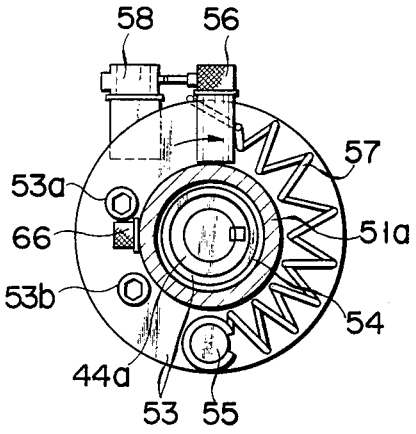

Further, detectors 58, 58 are provided at the outer end portions of the front rocking shafts 44*a* and 44*b*. The detectors 58, 58 are used for changing the running direction of the vehicle from forward to reverse. Referring now to FIGS. 7(*a*) and 7(*b*), one of the detector 58 at the outer end portion of the one front rocking shaft 44*a* and its surroundings will be described. The two detectors 58, 58 are constructed in the same manner.

The flange 51*a* is attached to the rocking shaft 44*a* for rotation within a predetermined angular range. A boss 53 is fixed to the outer end portion of the rocking shaft 44*a*, and a cylindrical member 54 for a smooth slide is fitted on the outer peripheral surface of the boss 53. The flange 51*a* is rotatably fitted on the outer periphery of the cylindrical member 54. A stopper bolt 66 is attached to the flange 51*a*, and bolts 53*a* and 53*b* to the boss 53. The stopper bolt 66 is interposed between the bolts 53*a* and 53*b*. Thus, the flange 51*a* can rotate relatively to the boss 53 within an angular range defined by the bolts 53*a* and 53*b*.

A tension spring 57 is stretched between a bolt 55 attached to the boss 53 and a bolt 56 on the flange 51*a*. The detector 58 is attached to the boss 53. For example, a limit switch is used for the detector 58.

Normally, the flange 51*a* is stopped at the position where the stopper bolt 66 engages the bolt 53*a*, urged by the tensile force of the tension spring 57. In this state, therefore, when the rocking shaft 44*a* rotates, the front imitation leg 3*a* swings correspondingly. If the imitation leg 3*a* runs against any obstacle in its course, it is pushed back by the obstacle. Accordingly, the flange 51*a* relatively rotates in the direction to stretch the tension spring 57 against its tensile force. Thus, the flange 51*a* relatively rotates until the stopper bolt 66 abuts against the bolt 53*b*.

In response to the above operation, the detector 58 is switched on. As the detector 58 is actuated, the motor 19 is reversed for a fixed time. The other detector 58 having the same construction and function as the one detector 58 is attached to the flange 51*b* of the right-side front imitation leg 3*b*.

Preferably, a touch switch (not shown) is attached to the front end portion of the head section 4, e.g., the nose of the animal to which the vehicle is compared. This touch switch is adapted to be turned on when the front end portion of the head section 4 comes into contact with an obstacle. When the touch switch is turned on, the motor 19 is reversed, so that the vehicle automatically starts to run in the opposite direction.

The circular steering wheel 6 is used for the steering means 59 of the vehicle. The circular wheel 6 may be replaced with handlebars or the like. The steering means 59 will now be described in detail.

As shown in FIG. 2, a supporting frame 60 is attached to the upper portion of the L-shaped frame 8*a* of the front frame 8. A bracket 61 is mounted on the extreme end portion of the supporting frame 60. A steering shaft 6*a* is rotatably supported by the bracket 61. A first rocking lever 62 is attached to the lower end portion of the steering shaft 6*a* so as to project forward. The steering wheel 6 is fixed to the upper end portion of the steering shaft 6*a*.

Vertical shafts 63*a* and 63*b* are passed through the left and right vertical portions of the front leg frame 8*b*, respectively. The vertical shafts 63*a* and 63*b* can rotate on their respective axes. The axle bearings 10, 10 are attached to the respective lower ends of the vertical shafts 63*a* and 63*b*. The front wheels 11, 11 are rotatably supported on the axle bearings 10, 10, individually.

Second rocking levers 64*a* and 64*b* are attached to the respective upper portions of the vertical shafts 63*a* and 63*b* so as to project forward. These second rocking levers 64*a* and 64*b* are coupled to the first rocking lever 62 by means of interlocking members 65*a* and 65*b*, respectively.

The operation of the vehicle with the above-mentioned construction will now be described.

A child gets astride the trunk section 2 of the body shell 1, and takes the steering wheel 6 in front of him. When a coin or coins needed to actuate the vehicle are thrown into the coin slot (not shown), the start switch is turned on, and the vehicle is run for a predetermined time. More specifically, the output shaft 19*a* of the motor 19 rotates in the direction indicated by an arrow in FIG. 2, so that the driving sprocket 20 is rotated. The driving sprocket 20 causes the chain 24 to travel in an endless manner. The chain 24 rotates the intermediate sprockets 25*a* and 25*b*, which cause the driving wheel 11*a* to rotate through the medium of the chain 26. When the vehicle starts to move as the driving wheel 11*a* starts rotating, the other wheels 11 are driven to rotate. Thus, the vehicle runs in the forward direction. If the user changes the changeover switch 7, the motor 19 is reversed, so that the vehicle is backed.

If the vehicle meets with a bumpy portion in a running surface A during the forward or reverse run, the front and rear frames 8 and 9 rock in the rolling direction around the hollow shaft 12. Thus, all the wheels 11 and 11*a* can simultaneously touch the running surface A without being suspended, so that the vehicle can enjoy a very stable run. In particular, the driving wheel 11*a* can securely be in contact with the running surface A, so that it is prevented from racing to interrupt the run.

During the run, the swinging means 29 is also driven by the motor 19. When the chain 24 is driven for endless traveling by the motor 19, the interlocking sprocket 33 rotates. As the interlocking sprocket 33 rotates, the interlocking shaft 32 also rotates. The rotation of the interlocking shaft 32 causes the crank 34 to rotate, so that the front and rear rods 35 and 36 simultaneously move in the same direction (forward or backward).

The forward or backward movement of the front rod 35 is transmitted to the front reciprocating plate 39 through the power transmission shaft 38. As the reciprocating plate 39 moves forward and backward, the levers 47*a* and 47*b* are pushed and pulled by the front links 49*a* and 49*b* to rock alternatingly. As a result, the rocking shafts 44*a* and 44*b* rotate alternatingly, so that the front imitation legs 3*a* and 3*b* swing forward and backward.

The forward or backward movement of the rear rod 36 is transmitted to the rear reciprocating plate 40. As the reciprocating plate 40 moves forward and backward, the levers 48*a* and 48*b* are pushed and pulled by the rear links 50*a* and 50*b* to rock alternatingly. As a result, the rocking shafts 45*a* and 45*b* rotate alternatingly, so that the rear imitation legs 3*c* and 3*d* swing forward and backward.

The power transmission shaft 38 is rotatably coupled to the front rod 35 by means of the ball joint 37. Also, the power transmission shaft 38 is rotatably passed through the hollow shaft 12. Thus, even though the front and rear frames 8 and 9 relatively rotate in the rolling direction, the longitudinal or axial movement of the power transmission shaft 38 will never be impeded.

The imitation legs 3*a* to 3*d* swing not at random but correlatively. In this embodiment, the front imitation legs 3*a* and 3*b*, along with the rear imitation legs 3*c* and 3*d*, move back and forth alternately with each other in imitation of the walking action of a dog or other four-footed animal. At the same time, the two left-side imitation legs 3*a* and 3*c*, along with the two right-side imitation legs 3*b* and 3*d*, move in opposite directions to each other. Thus, the vehicle can move in the forward and reverse directions, outwardly walking like a four-footed animal.

When the steering wheel 6 is rotated clockwise or counterclockwise, the first rocking lever 62, together with the steering shaft 6*a*, also rotates clockwise or counterclockwise. This motion of the rocking lever 62 is transmitted to the second rocking levers 64*a* and 64*b* through the interlocking members 65*a* and 65*b*, respectively. When the second rocking levers 64*a* and 64*b* rock, the vertical shafts 63*a* and 63*b* rock in the same direction therewith. Thus, the left- and right-side front wheels 11, 11 change their course for an angle corresponding to the angle of rotation of the steering wheel 6. As a result, the vehicle changes its course to the right or left while it is running.

If the front imitation leg 3*a* (or 3*b*) of the vehicle runs against any obstacle, it is prevented from rocking by the obstacle. As a result, the flange 51*a* (or 51*b*) rocks relatively to the rocking shaft 44*a* (or 44*b*) against the tensile force of the spring 57. Then, the detector 58 is switched on, so that the motor 19 is automatically reversed to backup the vehicle, thereby detaching it from the obstacle. Thus, the vehicle is safe enough to allow even an inexperienced child to enjoy himself running it without difficulty. If the vehicle is thus backed as a result of the actuation of the detector 58, the motor 19 will change its rotating direction again to forward after the passage of a predetermined time.

Figure 8:
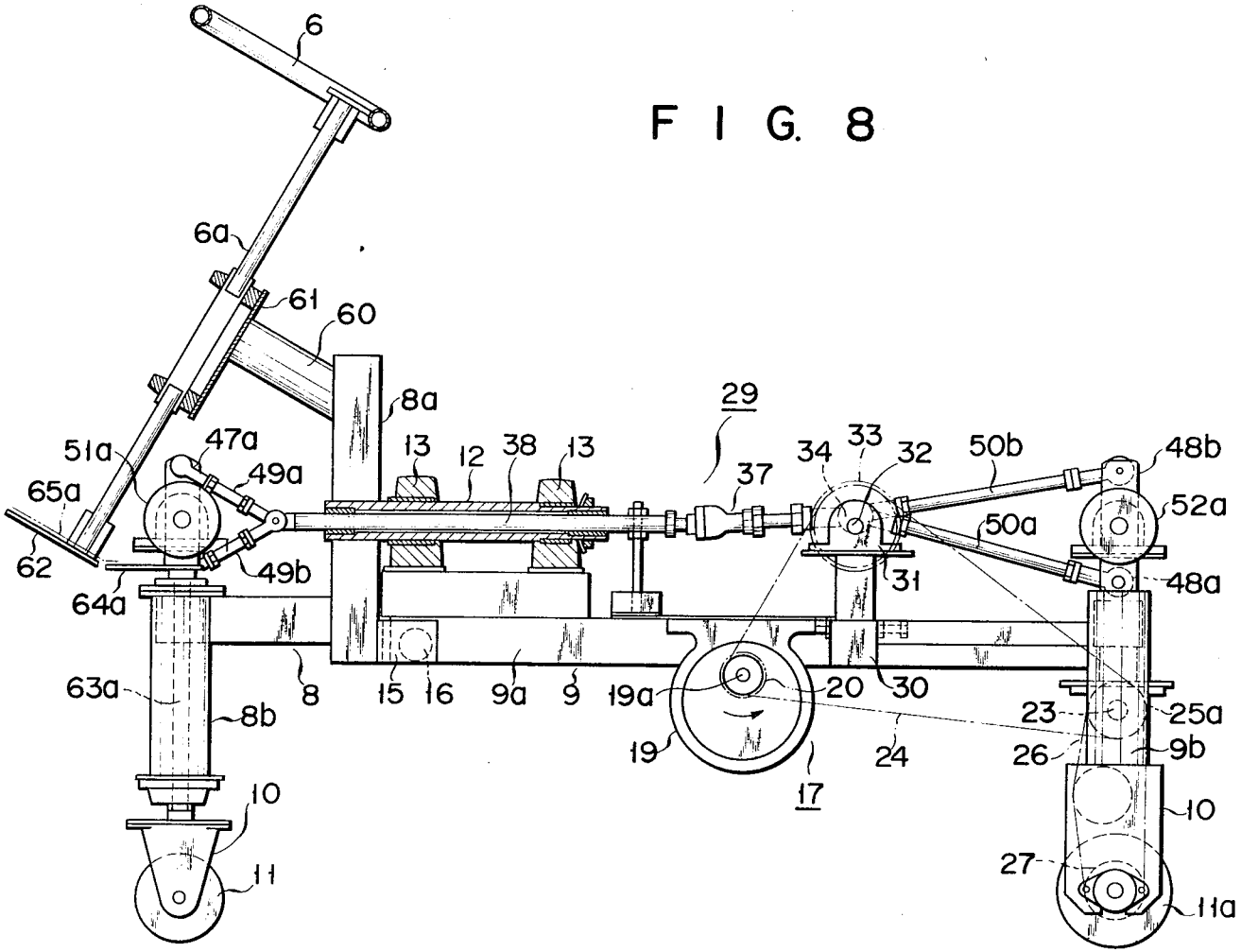
FIG. 8 is a side view partially in section illustrating the internal structure of a vehicle according to another embodiment of the invention.
Figure 9:
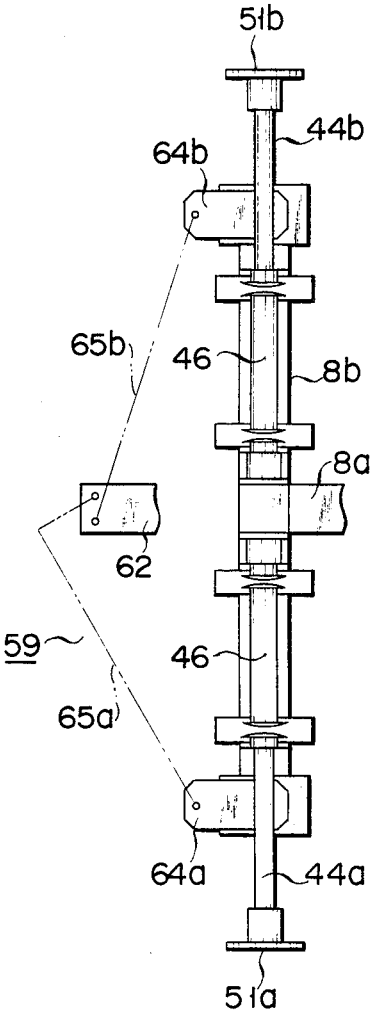
FIG. 9 is a plan view showing part of steering means of the vehicle of FIG. 8.

FIGS. 8 and 9 show another embodiment of the present invention. Swinging means 29 of this second embodiment does not include the reciprocating plates 39 and 40 which are used in the first embodiment. Namely, front links 49*a* and 49*b* are connected directly to a power transmission shaft 38, while rear links 50*a* and 50*b* are coupled to a crank 34. FIG. 9 shows a part of steering means 59 used in the second embodiment, in which a left-side interlocking member 65*a* is connected to the right side of a rocking lever 62, and a right-side interlocking member 65*b* to the left side of the rocking lever 62. Thus, the force required for the operation of the steering wheel is reduced. Other fundamental mechanisms of the second embodiment are constructed substantially in the same manner as those of the first embodiment shown in FIGS. 1 to 7.

The vehicle of the present invention may also be shaped in imitation of an imaginary animal or robot. The imitation legs 3*a* to 3*d* may require a change of motion sequence, depending on the kind of animal or the like after which the vehicle is modeled. This requirement may be satisfied by vertically changing the relative coupling positions of the front links 49*a* and 49*b* and the rear links 50*a* and 50*b*. Alternatively, both right and left-side rear wheels may be driven at the same time instead of driving only one of the rear wheels.

What is claimed is:

1. An amusement vehicle comprising:

a front frame including a front leg frame and front wheels attached to the lower portion of the front leg frame, said front wheels being adapted to change their course from side to side;

a rear frame including a rear leg frame and rear wheels attached to the lower portion of the rear leg frame;

a hollow shaft coupling the front and rear frames so as to be rockable in the rolling direction, thereby holding the front and rear wheels in contact with the ground;

drive means including a motor for rotating at least one of the front and rear wheels;

a pair of front imitation legs arranged in association with the front leg frame and swingable in the longitudinal direction of the vehicle;

a pair of rear imitation legs arranged in association with the rear leg frame and swingable in the longitudinal direction of the vehicle;

swinging means for driving the imitation legs, said swinging means including a power transmission shaft movably passed through the hollow shaft and adapted to drive the front and rear imitation legs in association with one another through the medium of the power transmission shaft;

steering means for changing the course of the front wheels as required; and a body shell covering the front and rear frames.

2. An amusement vehicle according to claim 1, wherein said body shell includes a hollow trunk section formed of fiber-reinforced plastics.

3. An amusement vehicle according to claim 2, wherein said body shell is shaped like a four-footed animal.

4. An amusement vehicle according to claim 1, wherein said drive means includes a first chain endlessly driven by the motor, an intermediate shaft rotated by the first chain, a second chain driven by the intermediate shaft, and a driven sprocket rotated by the second chain to rotate one of the rear wheels.

5. An amusement vehicle according to claim 4, wherein said drive means further includes a touch switch attached to the front end portion of the vehicle and adapted to be activated to reverse the motor when the front end portion of the vehicle comes into contact with an obstacle.

6. An amusement vehicle according to claim 4, wherein said drive means further includes a changeover switch attached to a suitable portion of the vehicle and adapted to be manually activated to reverse the motor.

7. An amusement vehicle according to claim 1, wherein said swinging means includes a crank rotated by the motor, the power transmission shaft axially reciprocated by the crank, a pair of front rocking shafts attached to the front frame and fitted individually with the front imitation legs, a pair of front levers fixed individually to the front rocking shafts, a pair of front links for transmitting the longitudinal motion of the power transmission shaft to the front levers, a pair of rear rocking shafts attached to the rear frame and fitted individually with the rear imitation legs, a pair of rear levers fixed individually to the rear rocking shafts, and a pair of rear links for transmitting the rotation of the crank to the rear levers.

8. An amusement vehicle according to claim 7, wherein said swinging means further includes a ball joint interposed between the crank and the power transmission shaft.

9. An amusement vehicle according to claim 7, wherein each said front imitation leg includes a flange capable of rotating relatively to each corresponding front rocking shaft within a predetermined angular range, a spring for urging the flange in a fixed rotating direction, and a detector adapted to be actuated to reverse the motor when the flange rotates against the urging force of the spring.

10. An amusement vehicle according to claim 1, wherein said steering means includes a steering shaft rotatably supported by the front frame, a steering wheel fixed to the upper portion of the steering shaft, a first rocking lever attached to the lower portion of the steering shaft, a pair of vertical shafts rotatably supported by the front leg frame and fitted individually with the front wheels at the lower ends thereof, a pair of second rocking levers fixed to the respective upper portions of the vertical shafts, and a pair of interlocking members connecting the first rocking lever and the second rocking levers.

* * * * *